US007907092B2

(12) United States Patent
Soler Castany et al.

(10) Patent No.: US 7,907,092 B2
(45) **Date of Patent: *Mar. 15, 2011**

(54) ANTENNA WITH ONE OR MORE HOLES

(75) Inventors: Jordi Soler Castany, Sant Cugat del Valles (ES); Carles Puente Baliarda, Sant Cugat del Valles (ES)

(73) Assignee: Fractus, S.A., Barcelona (ES)

( * ) Notice: Subject to any disclaimer, the term of this patent is extended or adjusted under 35 U.S.C. 154(b) by 159 days.

This patent is subject to a terminal disclaimer.

(21) Appl. No.: 12/246,964

(22) Filed: Oct. 7, 2008

(65) Prior Publication Data

US 2009/0073067 A1 Mar. 19, 2009

Related U.S. Application Data

(63) Continuation of application No. 11/036,509, filed on Jan. 12, 2005, now Pat. No. 7,471,246, which is a continuation of application No. PCT/EP02/07836, filed on Jul. 15, 2002.

(51) Int. Cl.
*H01Q 1/38* (2006.01)
*H01Q 13/12* (2006.01)
*H01Q 13/10* (2006.01)

(52) U.S. Cl. ..... 343/700 MS; 343/769; 343/770

(58) Field of Classification Search ..... 343/700 MS, 343/767, 769, 770, 793, 810
See application file for complete search history.

(56) References Cited

U.S. PATENT DOCUMENTS 5,210,542 A 5/1993 Pett et al.
5,606,733 A 2/1997 Kanayama
5,872,546 A 2/1999 Ihara et al.
6,097,345 A 8/2000 Walton
6,104,349 A 8/2000 Cohen
6,140,975 A 10/2000 Cohen
6,195,048 B1 2/2001 Chiba et al.
6,278,410 B1 8/2001 Soliman et al.
6,281,846 B1 8/2001 Puente Baliarda et al.
6,366,260 B1 4/2002 Carrender
6,407,710 B2 6/2002 Keilen
6,650,301 B1 11/2003 Zimmerman
6,806,834 B2 10/2004 Yoon (Continued)

FOREIGN PATENT DOCUMENTS

CA 2416437 A1 1/2002

(Continued)

OTHER PUBLICATIONS

Skrivervik , A. K. et al, PCS antenna design—The challenge of miniaturization, IEEE Antennas and Propagation Magazine, Aug. 2001.

(Continued)

*Primary Examiner* — Shih-Chao Chen
(74) *Attorney, Agent, or Firm* — Winstead PC

(57) ABSTRACT

A new type of multihole antenna which is mainly suitable for mobile communications or in general to any other application where the integration of telecom systems or applications in a single antenna is important. The antenna includes a radiating element which at least includes one hole. By means of this configuration, the antenna provides a broadband and multiband performance, and hence it features a similar behaviour through different frequency bands. Also, the antenna features a smaller size with respect to other prior art antennas operating at the same frequency.

42 Claims, 10 Drawing Sheets

U.S. PATENT DOCUMENTS

| | | | | |
|---|---|---|---|---|
| 6,809,692 | B2 | 10/2004 | Puente Baliarda et al. | |
| 7,123,208 | B2 | 10/2006 | Puente Baliarda et al. | |
| 7,471,246 | B2 * | 12/2008 | Soler Castany et al. | 343/700 MS |
| 2002/0175879 | A1 | 11/2002 | Sabet | |
| 2002/0177416 | A1 | 11/2002 | Boyle | |
| 2003/0193438 | A1 | 10/2003 | Yoon | |

FOREIGN PATENT DOCUMENTS

| | | | |
|---|---|---|---|
| GB | 2289163 | A1 | 11/1995 |
| GB | 2387486 | A | 10/2003 |
| JP | 61290803 | | 12/1986 |
| JP | 2131001 | | 5/1990 |
| JP | 3045530 | | 2/1991 |
| JP | 6291530 | | 10/1994 |
| JP | 6338816 | | 12/1994 |
| JP | 7-14714 | | 3/1995 |
| JP | 9036651 | | 2/1997 |
| JP | 9223921 | | 8/1997 |
| JP | 9270629 | | 10/1997 |
| JP | 10093331 | | 4/1998 |
| JP | 11150415 | | 6/1999 |
| JP | 2001094338 | | 4/2001 |
| JP | 2001-274619 | | 10/2001 |
| JP | 2002-509679 | | 3/2002 |
| JP | 2002-204123 | | 7/2002 |
| WO | WO-01/22528 | | 3/2001 |
| WO | 0126182 | A1 | 4/2001 |
| WO | WO-01/54225 | | 7/2001 |
| WO | 0180354 | A1 | 10/2001 |
| WO | 0235652 | A1 | 5/2002 |
| WO | 02095869 | A1 | 11/2002 |
| WO | WO-03/034538 | | 4/2003 |
| WO | 03/041216 | A2 | 5/2003 |

OTHER PUBLICATIONS

Baliarda, Carles Puente, et al; "An Iteractive Model for Fractal Antennas: Application to the Sierpinski Gasket Antenna", IEEE Transactions on Antennas ans Propagation, vol. 48, No. 5 May 2000, pp. 713-719.

Puente-Baliarda, Carles; "On the Behavoir of the Sierpinski Mulitband Fractal Antenna", IEEE Transactions on Antennas and Propagation, vol. 46, No. 4, Apr. 1998, pp. 517-524.

Soler, J et al; "Novel Broadband and Multiband Solutions for Planar Monopole Antennas", IEEE, 2002, p. 184.

Song, C. T. P. et al.; "Multi-circular Loop Monopole Antenna", Electronic Letters, Mar. 2, 2000, vol. 36, No. 5, 2 pages.

Puente, C. et al.; "Fractal Mulitband Antenna Based on the Sierpinski Gasket", Electronic Letters, Jan. 4, 1996, vol. 32, No. 1, pp. 1-2.

Agrawall, Narayan Prasad et al., "Net Wideband Monopole Antennas", IEEE, Antennas and Propagation Society International Symposium, 1997, vol. 1, pp. 248-251.

Song, C.T.P., et al, Sierpinski monopole antenna with controlled band spacing and input impedance, Electronic Letters, Jun. 24, 1999.

Puente, C. et al, Perturbation of the Sierpinski antenna to allocate operating bands, Electronic Letters, Nov. 21, 1996.

Puente, C. et al, Variations on the fractal Sierpinski antenna flare angle, IEEE Transaction on antennas and propagation, Jun. 1998.

Siah , E.S. et al, Experimental investigation of several novel fractal antennas—variants of the Sierpinski gasket and introducing fractal FSS screens, Asia Pacific Microwave Conference, Nov. 30, 1999.

Raman, S. et al, Single- and dual-polarized millimeter-wave slot-ring antennas, IEEE Transactions on Antennas and propagation, vol. 44, No. 11, Nov. 1996.

Navarro, Monica, "Diverse modifications applied to the Sierpinski antenna, a multi-band fractal antenna", Universitat Politecnica de Catalunya, Oct. 1997.

Kwon, Y.B., An internal triple-band planar inverted-F antenna, IEEE Antennas and Wireless Propagation Letters, 2003, vol. 2.

Song, P., Novel antenna design for future mobile systems, University of Birmingham, May 2001.

Vrenon, T. Fractal antennas offer benefits, copied from Radio World, Sep. 1999.

Tung, Integrated rectangular spiral monopole antenna for 2.4/5.2 GHz dual-band operation, Antennas and Propagation Society International Symposium, 2002, 496-499, vol. 3.

Cetiner, A packaged miniature antenna for wireless networking, International Symposium on Microelectronic International Microelectronics and Packaging Society (IMAPS), 2001.

Wong , S. et al, Analysis and bandwidth enhancement of Sierpinski carpet antenna, Microwave and optical technology letters, Oct. 5, 2001.

Robinson, R. Response to Office Action dated Nov. 7, 2006 of U.S. Appl. No. 11/036,509.

Mithani, S. Response to Office Action dated Mar. 21, 2006 of U.S. Appl. No. 11/036,509.

Robinson, R. Response to Office Action dated Jan. 24, 2008 of U.S. Appl. No. 11/036,509.

Robinson, R. Response to Office Action dated Apr. 25, 2007 of U.S. Appl. No. 11/036,509.

Chen, S. Office Action of U.S. Appl. No. 11/036,509 dated on Nov. 7, 2006.

Chen, S. Office Action of U.S. Appl. No. 11/036,509 dated on Mar. 21, 2006.

Chen, S. Office Action of U.S. Appl. No. 11/036,509 dated Jan. 24, 2008.

Chen, S. Office of Action of U.S. Appl. No. 11/036,509 dated Apr. 25, 2007.

Chen, S. Notice of Allowance of U.S. Appl. No. 11/036,509 dated Sep. 2008.

McCormick, J. A Low-profile electrically small VHF antenna. 15th Annual Symposium on the USAF antenna reserach and development program. Oct. 1965.

Zhang, S. Huff, G.; Bernhard, T. Antenna efficiency and gain of two new compact microstrip antennas. Antenna Applications symposium. Sep. 2001.

NA. OET Exhibits list for FCC ID: LJPNSW-6NX. Federal Communications Commission-FCC. Jul. 1999.

* cited by examiner

ANTENNA WITH ONE OR MORE HOLES

CROSS-REFERENCE TO RELATED APPLICATIONS

This patent application is a continuation application of, and incorporates by reference the entire disclosure of, U.S. patent application Ser. No. 11/036,509, which was filed on Jan. 12, 2005 now U.S. Pat. No. 7,471,246. U.S. patent application Ser. No. 11/036,509 is a continuation application of International Patent Application No. PCT/EP02/07836, which was filed on Jul. 15, 2002. U.S. patent application Ser. No. 11/036,509 and International Patent Application No. PCT/EP02/07836 are incorporated herein by reference.

BACKGROUND OF THE INVENTION

1. Technical Field of the Invention

The present invention relates to a novel multihole antenna which operates simultaneously at several frequencies with an improved impedance match. Also, the antenna features a smaller size with respect to other prior art antennas operating at the same frequency.

The radiating element of the novel multihole antenna consists of an antenna shaped by means of a polygonal, space-filling, loaded or multilevel shape, which at least includes one hole in the radiating antenna surface.

The invention refers to a new type of multihole antenna which is mainly suitable for mobile communications or in general to any other application where the integration of telecom systems or applications in a single antenna is important.

2. Description of Related Art

The growth of the telecommunication sector, and in particular, the expansion of personal mobile communication systems, is driving the engineering efforts to develop multiservice (multifrequency) and compact systems which require multifrequency and small antennas. Therefore, the use of a multisystem small antenna with a multiband and/or wideband performance, which provides coverage of the maximum number of services, is nowadays of notable interest since it permits telecom operators to reduce their costs and to minimize the environmental impact.

Most of the multiband reported antenna solutions use one or more radiators or branches for each band or service. An example is found in U.S. Ser. No. 09/129,176 entitled "Multiple band, multiple branch antenna for mobile phone."

One of the alternatives which can be of special interest when looking for antennas with a multiband and/or small size performance are multilevel antennas, Patent publication WO0122528 entitled "Multilevel Antennas," miniature space-filling antennas, Patent publication WO0154225 entitled "Space-filling miniature antennas," and loaded antennas, Patent application PCT/EP01/11914 entitled "Loaded Antenna."

N. P. Agrawall ("New wideband monopole antennas," Antennas and Propagation Society International Symposium, 1997, IEEE, vol. 1, pp. 248-251) presents the results for a set of solid planar polygonal monopole antennas, which are not the case of the present invention.

SUMMARY OF THE INVENTION

The key point of the invention is the shape of the radiating element which includes a set of holes practised in the radiating element. According to the present invention the antenna is a monopole or a dipole which includes at least one hole. Also, the antenna can include different holes with different shapes and sizes in a radiating element shaped by means of a polygonal, multilevel or loaded structure.

Due to the addition of the holes in the radiating element, the antenna can feature a multifrequency behaviour with a smaller size with respect to other prior art antennas operating at the same frequency. In typical embodiments, the radiating element is shorter than a quarter of the longest operating wavelength of the antenna. For the mentioned multifrequency behaviour, said hole in a monopole or dipole antenna features an area of at least a 20% of the area included inside the external perimeter of the radiating element of said antenna.

The novel monopole or dipole includes a radiating element of a conducting or superconducting material with at least one hole, wherein the hole can be filled with a dielectric or partially filled by a conducting or superconducting material different from the conductor used for the radiating element.

In the novel antenna, the holes, or a portion of them, can be shaped with a geometry chosen form the set: multilevel, loaded, space-filling or polygonal structures. These geometries being understood as described in the previously identified patents.

The main advantage of this novel multihole antenna is two-folded:

The antenna features a multifrequency behaviour.

The antenna can be operated at a lower frequency than most of the prior art antennas.

BRIEF DESCRIPTION OF THE DRAWINGS

FIG. 9 shows a multihole antenna. Case 25 shows a radiating element with a circular shape with two identical holes (25*a*) and with a third bigger hole (25*b*).

DETAILED DESCRIPTION OF ILLUSTRATIVE EMBODIMENTS OF THE INVENTION

Embodiment(s) of the invention will now be described more fully with reference to the accompanying Drawings. The invention may, however, be embodied in many different forms and should not be construed as limited to the embodiment(s) set forth herein. The invention should only be considered limited by the claims as they now exist and the equivalents thereof.

Figure 5:
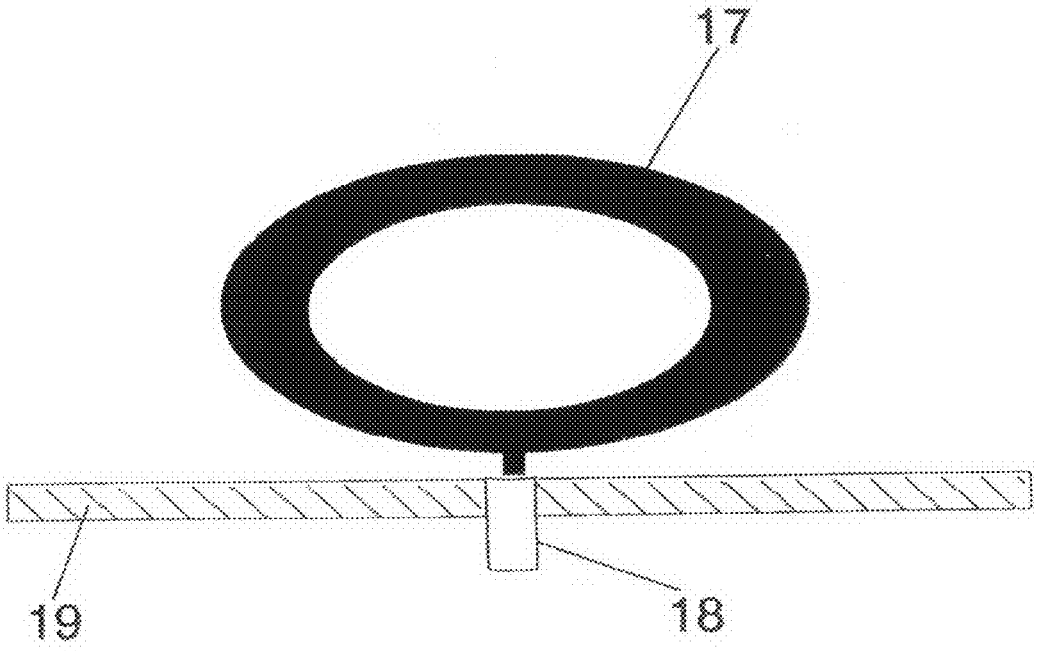
FIG. 5 shows two particular cases of multihole antenna. They consist of a monopole comprising a conducting or superconducting ground plane with an opening to allocate a coaxial cable (18) with its outer conductor connected to said ground plane and the inner conductor connected to the multihole radiating element (17). The radiating element (17) can be optionally placed over a supporting dielectric (20).
Figure 5:
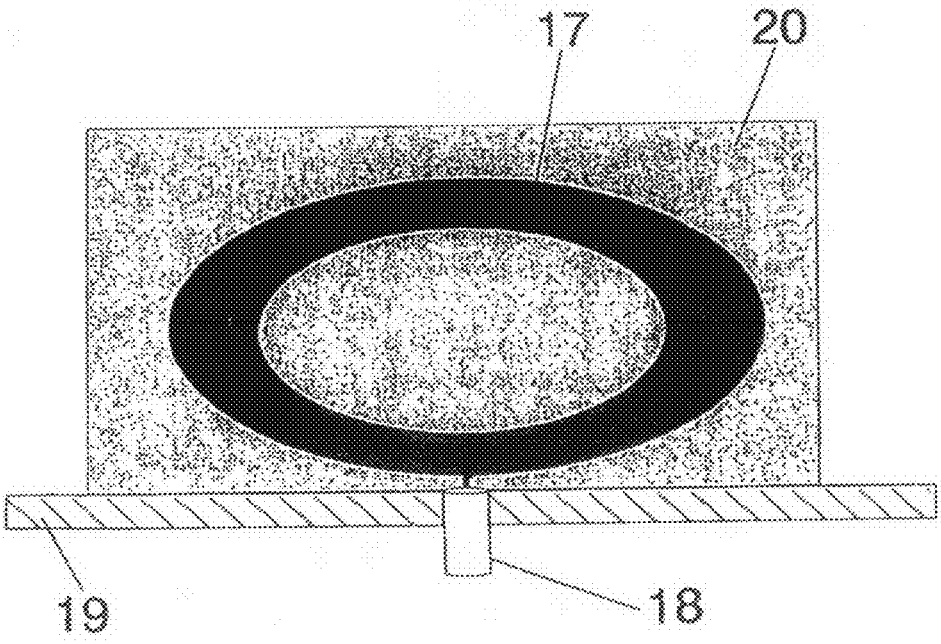

A preferred embodiment of the multihole antenna is a monopole configuration as shown in FIG. 5. A handheld telephone case, or even a part of the metallic structure of a car or train, can act as such a ground counterpoise. The ground and the monopole arm (17) (here a particular embodiment of the arm is represented, but any of the mentioned multihole antenna structures could be taken instead) are excited as usual in prior art monopole by means of, for instance, a transmission line (18). Said transmission line is formed by two conductors, a first conductor is connected to a point of the conducting or superconducting multihole structure and the second conductor is connected to the ground plane or to a ground counterpoise. In FIG. 5, a coaxial cable (18) has been taken as a particular case of transmission line, but it is clear to any skilled in the art that other transmission lines (such as for instance a microstrip arm) could be used to excite the monopole. Optionally, and following the scheme just described, the multihole monopole can be printed, etched or attached, for instance, over a dielectric substrate (20).

Figure 1:
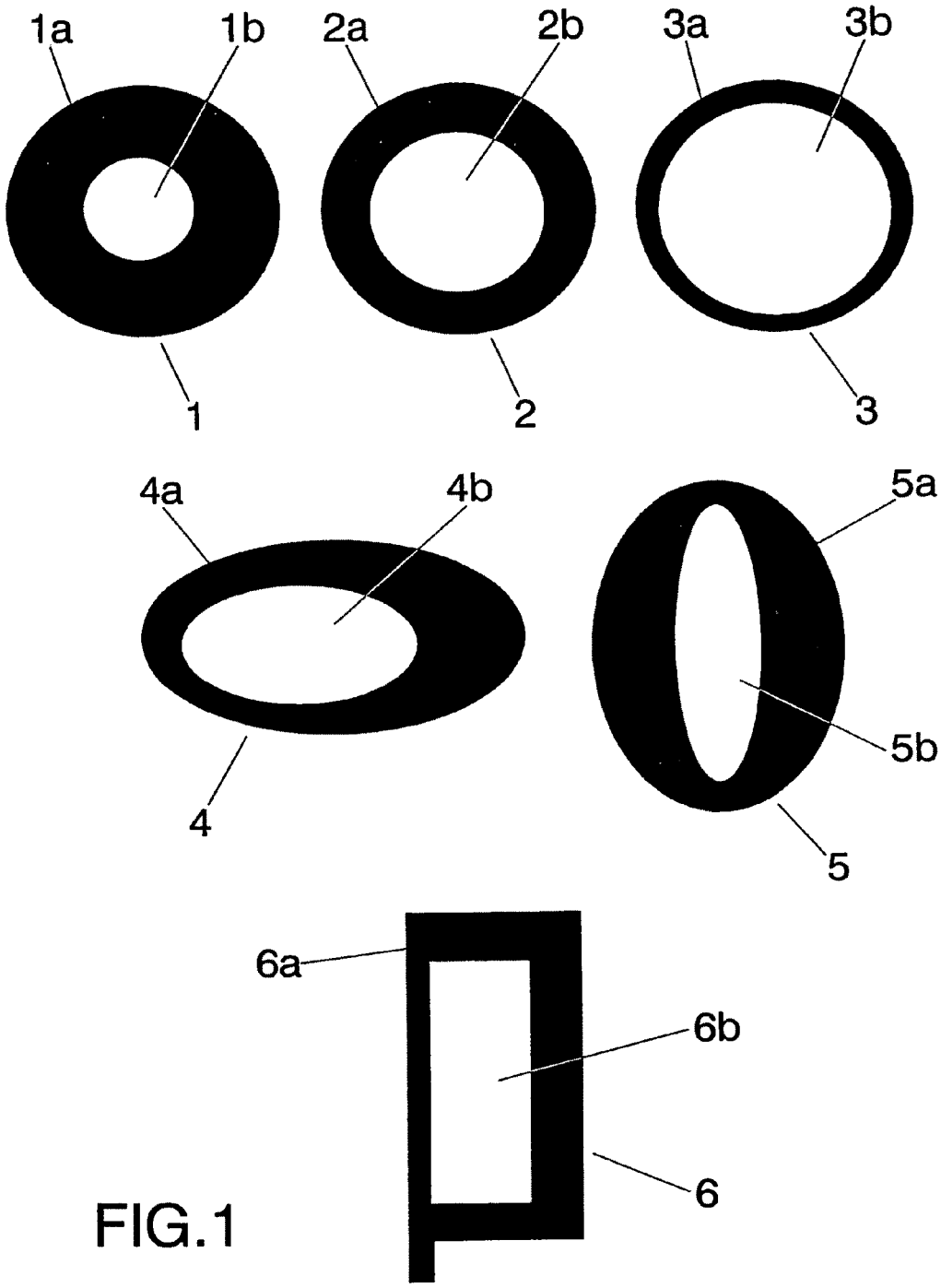
FIG. 1 shows three different antennas including one hole; those are, a circular, an elliptical, and a rectangular antenna. All the cases are polygonal shapes, including the circles and the ellipses as they can be considered polygonal structures with a large number of sides. Cases 1 to 3 show an antenna where the radiating element (1*a*, 2*a*, 3*a*) is a circle including one hole (1*b*, 2*b*, 3*b*), wherein the size of the hole (1*b*, 2*b*, 3*b*) increases from cases 1 to 3, being the biggest one (3*b*) and the smallest one case (1*b*). Also, cases 1 to 3 include a hole (1*b*, 2*b*, 3*b*) with a circular shape. Case 4 and 5 describe an elliptical monopole with an elliptical hole (4*b*, 5*b*). In case 4, the hole (4*b*) is not symmetrically located with respect to the vertical axis of the radiating element (4*a*). Case 6 shows a rectangular monopole including one rectangular hole (6*b*). In all cases in FIG. 1 the area of the hole (1*b*, 2*b*, 3*b*, 4*b*, 5*b*, 6*b*) is at least a 20% of the area included in the external perimeter of the radiating element (1*a*, 2*a*, 3*a*, 4*a*, 5*a*, 6*a*).
Figure 2:
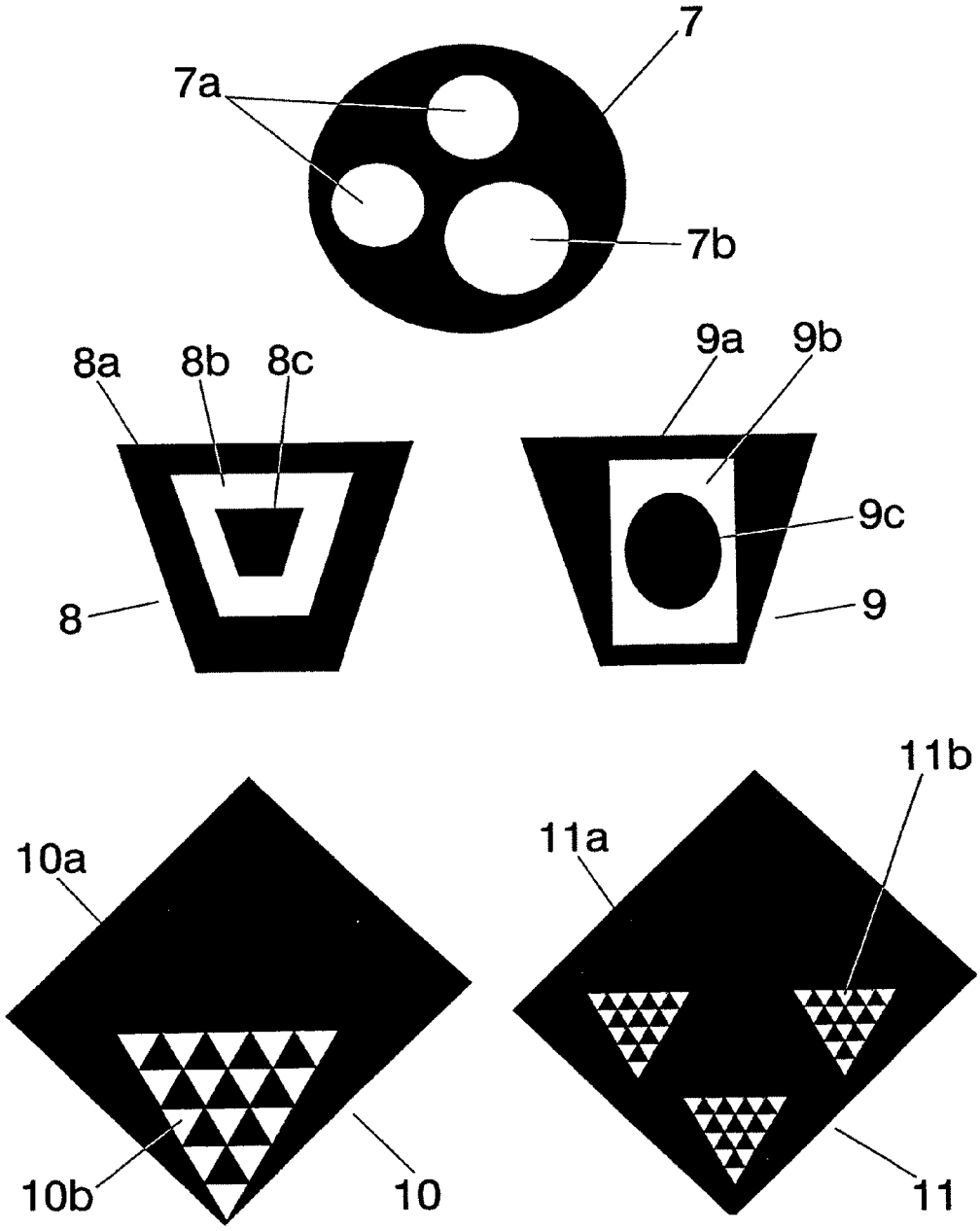
FIG. 2 shows three different types of multihole antenna. Case 7 shows a radiating element with a circular shape with two identical circular holes (7*a*) and with a third bigger hole (7*b*). The antennas in cases 8 and 9 are multihole antennas where the hole (8*b*, 9*b*) is shaped as a curve, said curve intersecting itself at a point. Cases 10 and 11 shows a polygonal radiating element (10*a*, 11*a*) with one (10*b*) and three holes (11*b*), respectively, shaped using a multilevel structure.
Figure 3:
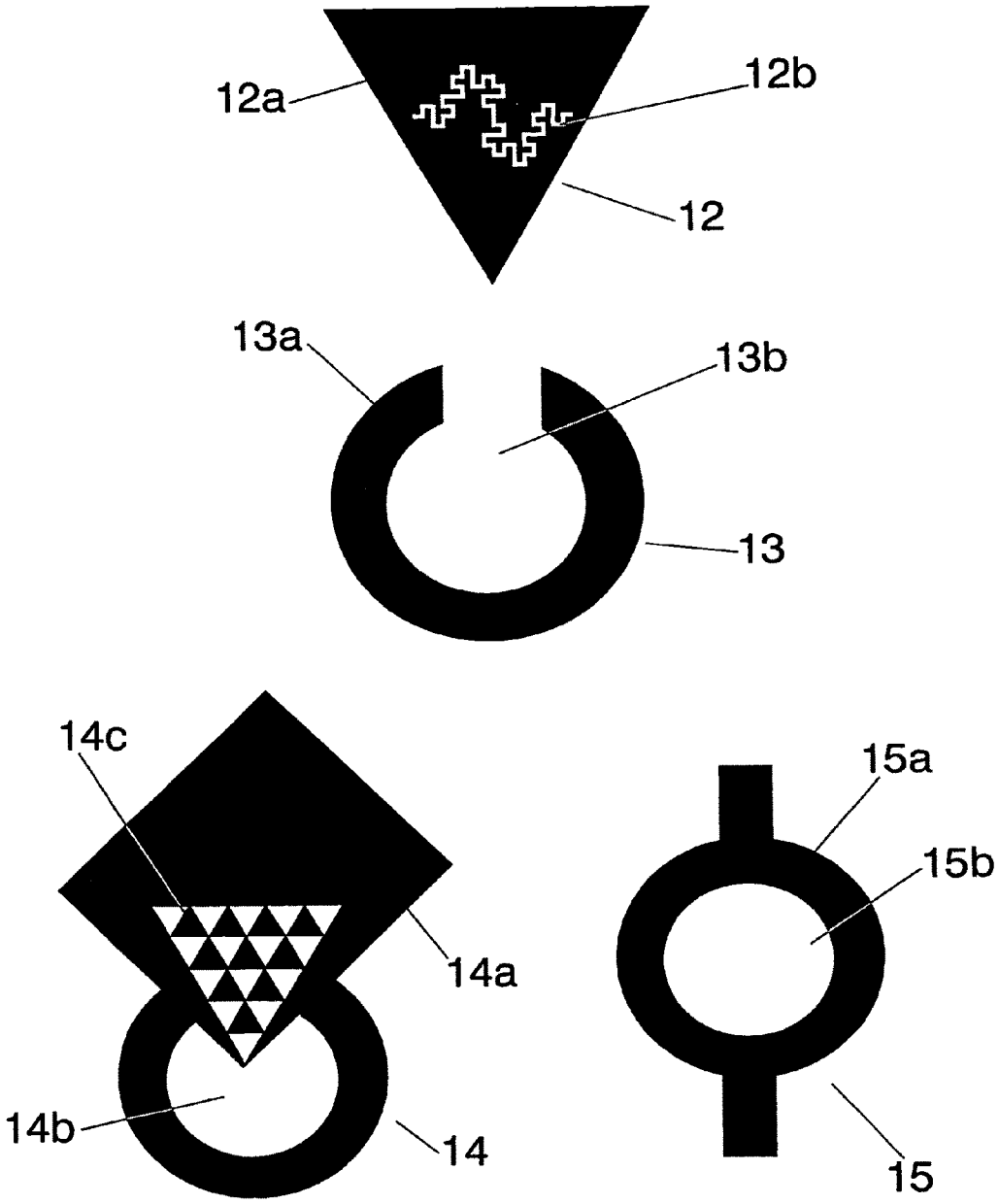
In FIG. 3, case 12 shows a radiating element with a triangular shape which includes one hole shaped by means of a space-filling curve (12*b*). Case 13 shows a multihole antenna with a circular hole, wherein the hole intersects the perimeter of the radiating element at a distance to the feeding point shorter than a quarter, or longer than three quarters, of the external perimeter of the radiating element. Case 14 describes a radiating element (14*a*) composed by a rectangular and a circular shape, which includes two holes; those are, a circular-shaped hole (14*b*) and a hole shaped by means a multilevel structure (14*c*). Case 15 shows another radiating element with a hole with a circular shape (15*b*).
Figure 4:
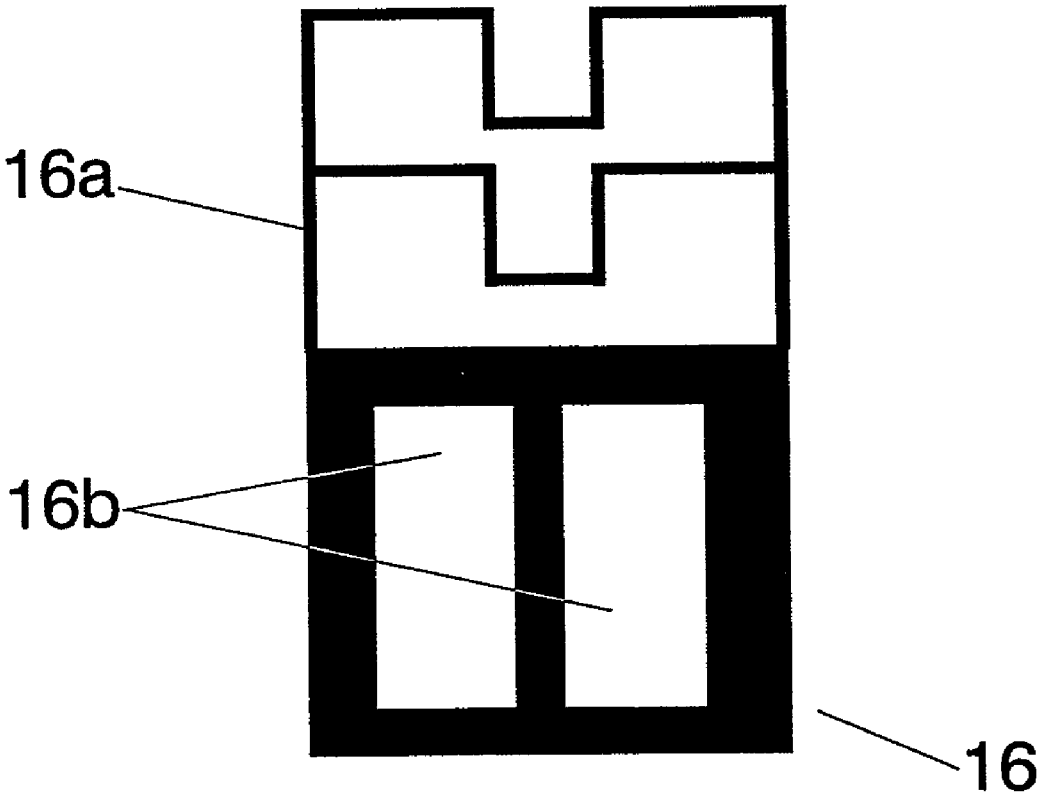
FIG. 4, case 16, shows a loaded radiating element (16*a*) including two rectangular holes (16*b*).
Figure 6:
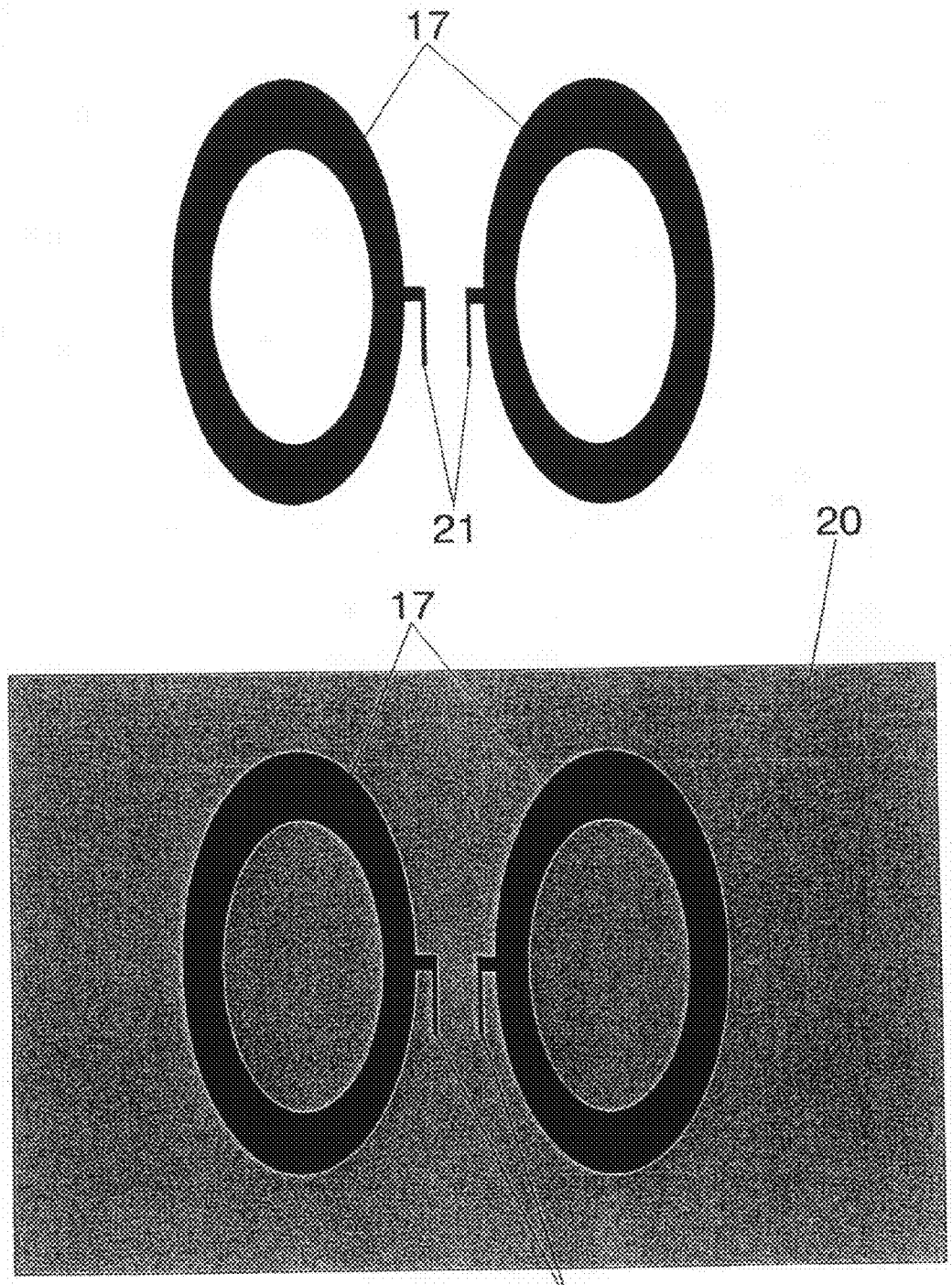
FIG. 6 shows a multihole antenna consisting of a dipole wherein each of the two arms includes one hole. The lines (21) indicate the input terminals points. The two drawings display different configurations of the same basic dipole; in the lower drawing the radiating element is supported by a dielectric substrate (20).

FIG. 6 describes another preferred embodiment of the invention. A two-arm antenna dipole is constructed comprising two conducting or superconducting parts, each part being a multihole structure. For the sake of clarity but without loss of generality, a particular case of the multihole antenna (17) has been chosen here; obviously, other structures, as for instance, those described in FIG. 1 could be used instead. In this particular case, two points (21) on the perimeter of each arm can are taken as the input part of the dipole structure. In other embodiments, other point can be takes as the input terminals. The terminals (21) have been drawn as conducting or superconducting wires, but as it is clear to those skilled in the art, such terminals could be shaped following any other pattern as long as they are kept small in terms of the operating wavelength. Those skilled in the art will notice that the arms of the dipoles can be rotated and folded in different ways to finely modify the input impedance or the radiation properties of the antenna, such as, for instance, polarization.

Another preferred embodiment of a multihole dipole antenna is also shown in FIG. 6 where the multihole arms are printed over a dielectric substrate (20); this method is particularly convenient in terms of cost and mechanical robustness when the shape of the radiating element contains a high number of polygons, as happens with multilevel structures. Any of the well-known printed circuit fabrication techniques can be applied to pattern the multihole antenna structure over the dielectric substrate. Said dielectric substrate can be, for instance, a glass-fibre board, a teflon based substrate (such as Cuclad®) or other standard radiofrequency and microwave substrates (as for instance Rogers 4003® or Kapton®). The dielectric substrate can be, for instance, a portion of a window glass if the antenna is to be mounted in a motor vehicle such as a car, a train, or an airplane, to transmit or receive radio, TV, cellular telephone (GSM900, GSM1800, UMTS), or other communication services electromagnetic waves. Of course, a balun network can be connected or integrated in the input terminals of the dipole to balance the current distribution among the two dipole arms.

Figure 7:
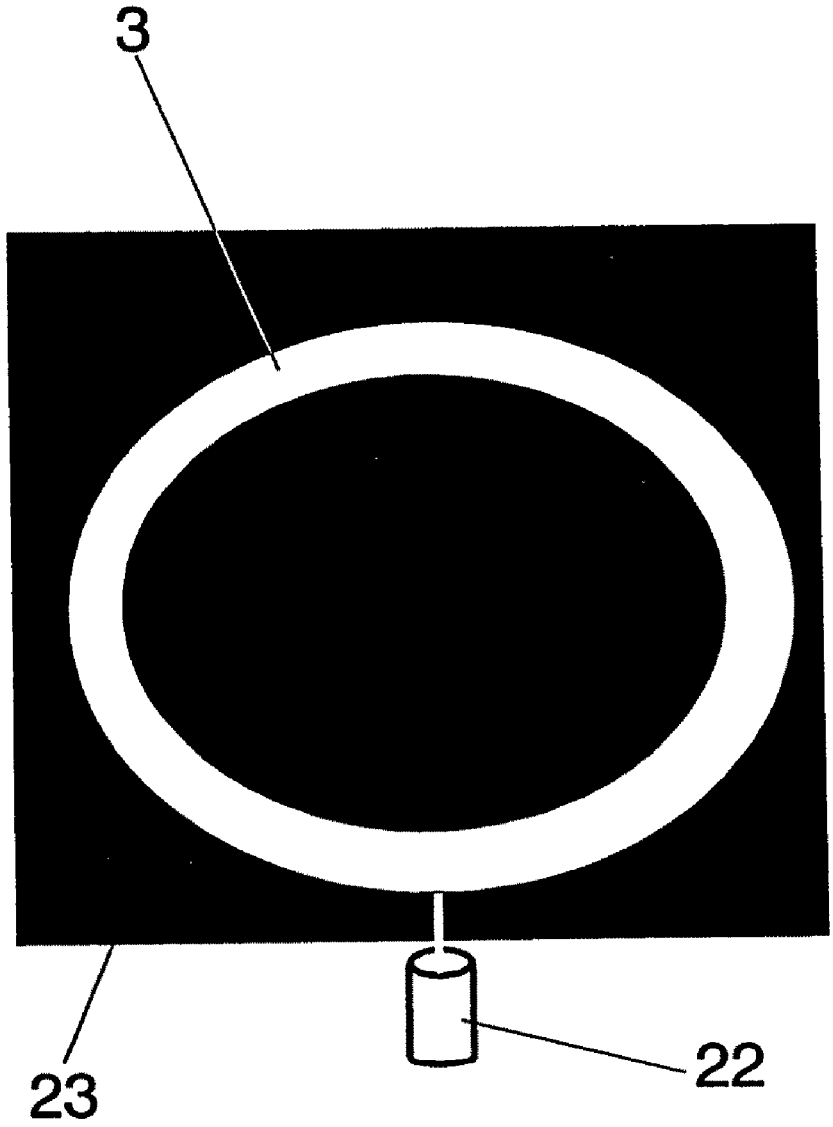
FIG. 7 shows an aperture antenna, wherein a multihole structure is practiced as an aperture antenna (3). The aperture is practiced on a conducting or superconducting structure (23).

Another preferred embodiment of the multihole antenna is an aperture configuration as shown in FIG. 7. In this figure the multihole elliptical structure (3) forms a slot or gap impressed over a conducting or superconducting sheet (23). Such sheet can be, for instance, a sheet over a dielectric substrate in a printed circuit board configuration, a transparent conductive film such as those deposited over a glass window to protect the interior of a car from heating infrared radiation, or can even be apart of the metallic structure of a handheld telephone, a car, train, boat or airplane. The feeding scheme can be any of the well known in conventional slot antenna and it does not become an essential part of the present invention. In the illustration in FIG. 7, a coaxial cable (22) has been used to feed the antenna, with one of the conductors connected to one side of the conducting sheet and the other connected at the other side of the sheet across the slot. A microstrip line could be used, for instance, instead of a coaxial cable.

Figure 8:
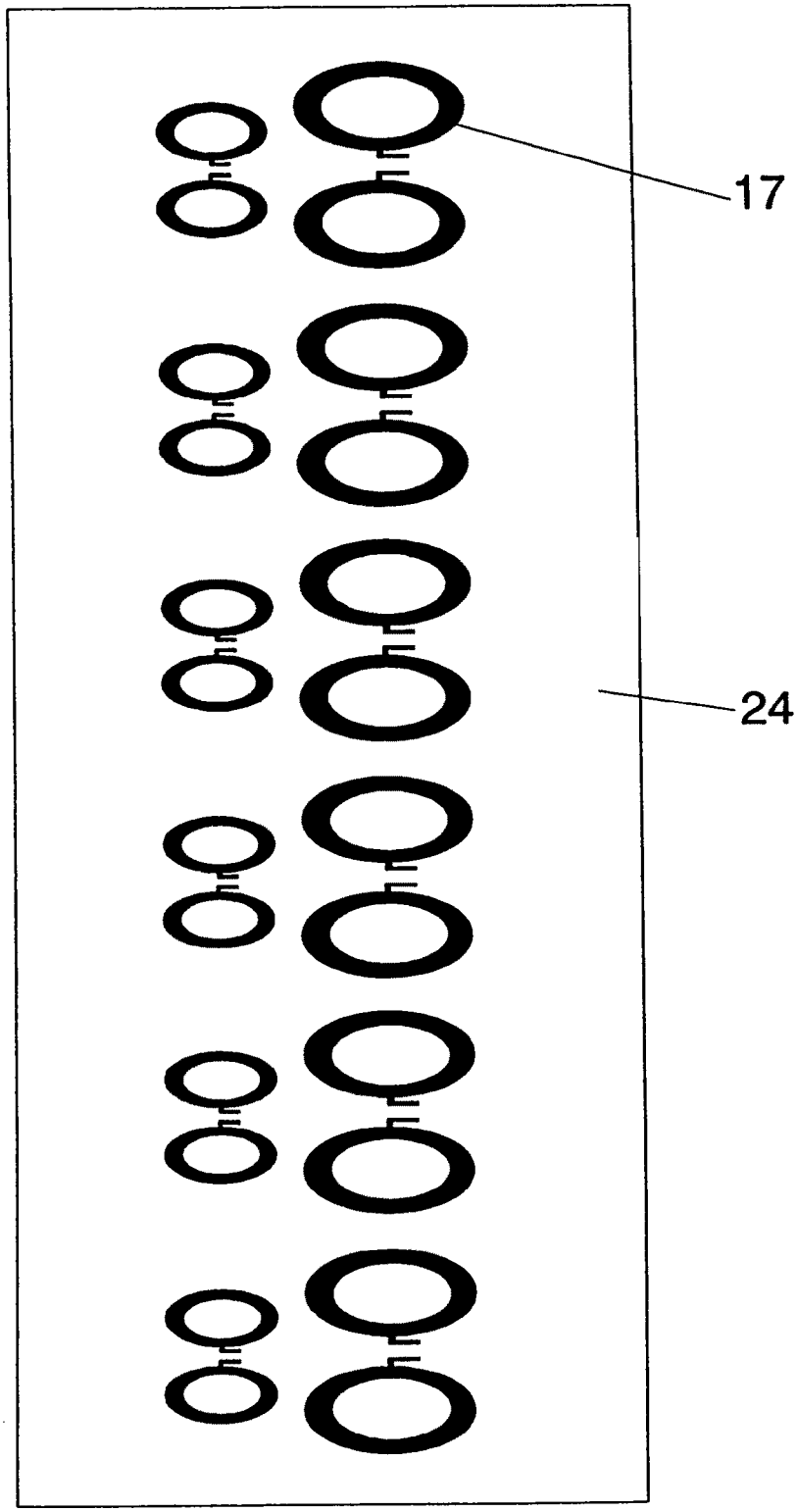
FIG. 8 shows an antenna array (24) including multihole radiating elements (17).
Figure 9:
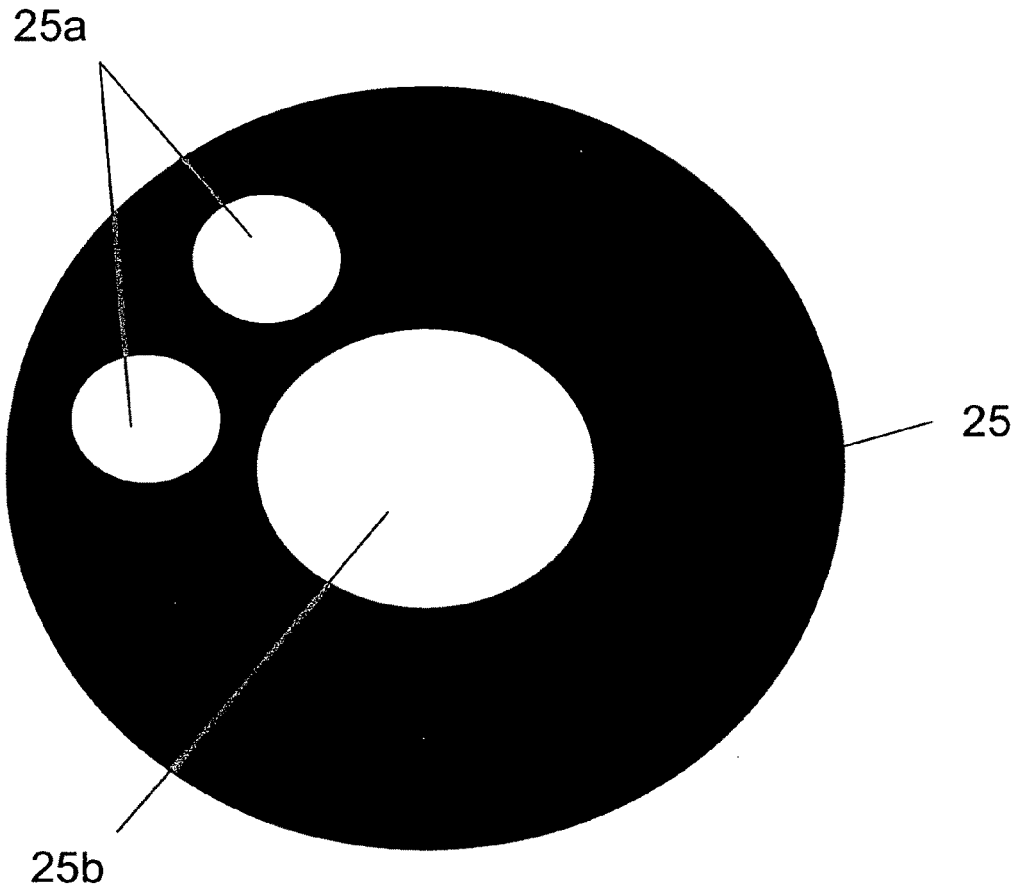
FIG. 9 shows an antenna in which the perimeter of a hole formed therein is shaped with a hexagonal geometry.
Figure 10:
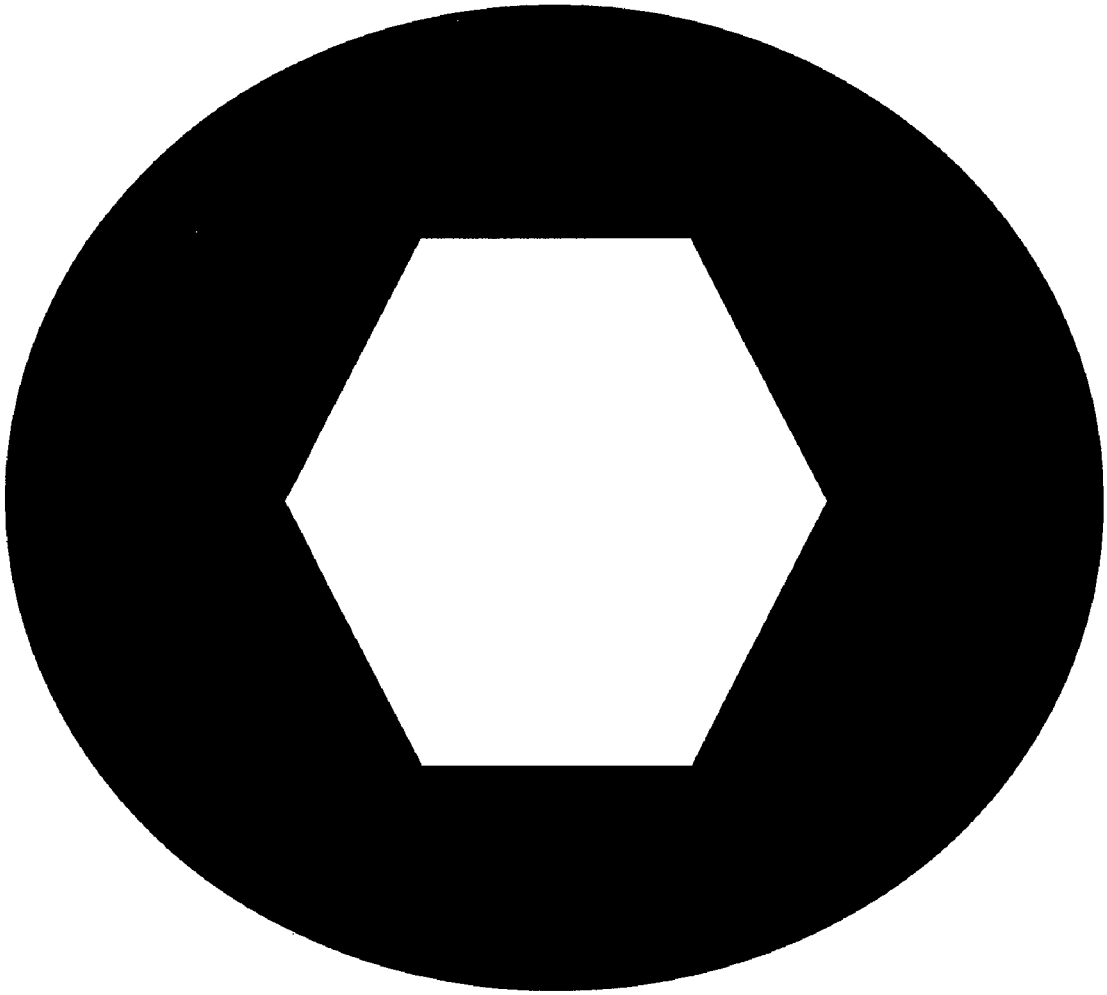
FIG. 10 shows an antenna, having a circular radiating element, in which the perimeter of a hole formed therein is shaped with a hexagonal geometry.

FIG. 8 describes another preferred embodiment. It consists of an antenna array (24) which includes at least one multihole dipole antenna (17).

Although various embodiments of the method and system of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth herein

What is claimed is:

1. A wireless device comprising:

a radiating element, the radiating element comprising:

a conducting body including a hole;

an input terminal;

a ground plane, the ground plane operating in cooperation with the radiating element;

a dielectric support, wherein the radiating element is arranged on the dielectric support;

a feeding means, the feeding means being coupled to the input terminal;

wherein the radiating element defines an external perimeter;

wherein the hole has an area of at least 20% of an area included inside the external perimeter;

wherein the external perimeter of the radiating element is shaped as a first polygonal shape comprising at least four sides;

wherein a perimeter of the hole is shaped as a second polygonal shape comprising a plurality of sides;

wherein the first polygonal shape and the second polygonal shape are not similar;

wherein the radiating element is shorter than a quarter of a longest operating wavelength of the wireless device; and wherein the wireless device is operative at multiple frequency bands.

2. The wireless device according to claim 1, wherein the first polygonal shape comprises a different number of sides than the second polygonal shape.

3. The wireless device according to claim 2, wherein the first polygonal shape comprises more sides than the second polygonal shape.

4. The wireless device according to claim 1, wherein the first polygonal shape and the second polygonal shape both comprise more than five sides.

5. The wireless device according to claim 4, wherein the first polygonal shape and the second polygonal shape both comprise more than seven sides.

6. The wireless device according to claim 1, wherein at least one of the first polygonal shape and the second polygonal shape comprises at least one curved side.

7. The wireless device according to claim 1, wherein at least a portion of the radiating element comprises a multilevel structure.

8. The wireless device according to claim 7, wherein the hole defines a second multilevel structure.

9. The wireless device according to claim 7, wherein at least a portion of the perimeter of the hole is shaped as a space-filling curve.

10. The wireless device according to claim 1, wherein at least a portion of the external perimeter of the radiating element is shaped as a space-filling curve.

11. The wireless device according to claim 1, wherein the hole intersects the external perimeter of the radiating element.

12. The wireless device according to claim 11, wherein said intersection is at a distance from the input terminal shorter than a quarter of a length of the external perimeter of the radiating element.

13. The wireless device according to claim 1, wherein the input terminal is located at a point on the perimeter of the hole.

14. The wireless device according to claim 1, wherein the radiating element is an arm of a monopole antenna.

15. The wireless device according to claim 1, wherein at least a portion of the radiating element is rotated or folded, so that the radiating element lies on more than one plane.

16. The wireless device according to claim 15, wherein the perimeter of the hole comprises sides located on more than one plane.

17. The wireless device according to claim 1, wherein the conducting body of the radiating element is a conductive film.

18. The wireless device according to claim 17, wherein the dielectric support is flexible.

19. The wireless device according to claim 1, wherein dielectric support is arranged substantially above the ground plane, so that the dielectric support has a projection that at least partially overlaps the ground plane.

20. The wireless device of claim 1, wherein the wireless device operates as a cellular telephone.

21. The wireless device of claim 1, wherein at least one of the multiple frequency bands is used by a GSM or UMTS communication service.

22. The wireless device of claim 1, wherein a first one of said multiple frequency bands is used by a GSM communication service and a second one of said multiple frequency bands is used by a UMTS communication service.

23. The wireless device of claim 1, wherein the wireless device is operative according to at least GSM900, GSM1800, and UMTS.

24. The wireless device of claim 1, wherein the wireless device is operative at least at four frequency bands.

25. The wireless device of claim 1, wherein the wireless device is operative at least at five frequency bands.

26. A wireless device comprising:

a radiating element, the radiating element comprising:

a conducting body including a plurality of holes;

an input terminal;

a ground plane, the ground plane operating in cooperation with the radiating element;

a dielectric support, wherein the radiating element is arranged on the dielectric support;

a feeding means, the feeding means being coupled to the input terminal;

wherein the radiating element defines an external perimeter;

wherein the plurality of holes have a combined area of at least 20% of an area included inside the external perimeter;

wherein the external perimeter of the radiating element is shaped as a polygonal shape comprising at least four sides;

wherein a perimeter of a first hole of the plurality of holes comprises at least three sides;

wherein a perimeter of a second hole of the plurality of holes comprises at least three sides;

wherein the perimeter of the first hole and the perimeter of the second hole have different number of sides;

wherein the radiating element is shorter than a quarter of a longest operating wavelength of the wireless device; and wherein the wireless device is operative at multiple frequency bands.

27. The wireless device according to claim 26, wherein the first polygonal shape, the perimeter of the first hole, and the perimeter of the second hole each comprise more than five sides.

28. The wireless device according to claim 26, wherein at least one of the polygonal shape, the perimeter of the first hole, and the perimeter of the second hole comprises at least one curved side.

29. The wireless device according to claim 26, wherein at least a portion of the radiating element comprises a multilevel structure.

30. The wireless device according to claim 29, wherein at least one hole of the plurality of holes defines a multilevel structure.

31. The wireless device according to claim 29, wherein at least one hole of the plurality of holes is shaped as a space-filling curve.

32. The wireless device according to claim 26, wherein at least one hole of the plurality of holes intersects the external perimeter of the radiating element.

33. The wireless device according to claim 32, wherein said intersection is at a distance from the input terminal shorter than a quarter of a length of the external perimeter of the radiating element.

34. The wireless device according to claim 26, wherein the radiating element is an arm of a monopole antenna.

35. The wireless device according to claim 26, wherein at least a portion of the radiating element is rotated or folded, so that the radiating element lies on more than one plane.

36. The wireless device according to claim 26, wherein the conducting body of the radiating element is a conductive film, and wherein the dielectric support is flexible.

37. The wireless device of claim 26, wherein the wireless device operates as a cellular telephone.

38. The wireless device of claim 26, wherein at least one of the multiple frequency bands is used by a GSM or UMTS communication service.

39. The wireless device of claim 26, wherein a first one of said multiple frequency bands is used by a GSM communication service and a second one of said multiple frequency bands is used by a UMTS communication service.

40. The wireless device of claim 26, wherein the wireless device is operative according to at least GSM900, GSM1800, and UMTS.

41. The wireless device of claim 26, wherein the wireless device is operative at least at four frequency bands.

42. The wireless device of claim 26, wherein the wireless device is operative at least at five frequency bands.

* * * * *